United States Patent [19]

Lever

[11] 3,978,505

[45] Aug. 31, 1976

[54] PHOTOGRAPHIC PROCESSING TANK

[76] Inventor: Al Lever, 12607 Waverly Place, Bowie, Md. 20715

[22] Filed: Jan. 24, 1975

[21] Appl. No.: 543,758

[52] U.S. Cl. ..... 354/307
[51] Int. Cl.[2] ..... G03D 17/00
[58] Field of Search ..... 354/307, 297, 331

[56] References Cited

UNITED STATES PATENTS

| | | | |
|---|---|---|---|
| 1,208,244 | 12/1916 | Waite | 354/307 |
| 1,501,904 | 7/1924 | Harris | 354/307 |
| 2,419,859 | 4/1947 | Tarr | 354/307 |
| 3,677,163 | 7/1972 | Porter | 354/307 |

*Primary Examiner*—John Gonzales
*Attorney, Agent, or Firm*—Burton Scheiner

[57] ABSTRACT

A photographic film and print processing tank having a bottom drain valve which in a preferred embodiment coacts with a tank support stand whereby the valve and stand cooperate to facilitate rapid substantial draining of processing solution and recovery thereof for reuse. The size of the tank is selectively variable to enable the volumetric capacity, and vertical extent, of the tank to be adjusted to minimize the amount of processing solution required for processing varying amounts and sizes of photographic film or print material.

7 Claims, 8 Drawing Figures

PHOTOGRAPHIC PROCESSING TANK

BACKGROUND OF THE INVENTION

1. Field of the Invention

The invention relates to photographic materials processing apparatus and more particularly to a light tight processing tank apparatus for the processing or treating of photographic material such as the developing, fixing and washing of photographic film and paper, either black and white or color.

2. Description of the Prior Art

Equipment such as tank processors for photographic film and print material, in roll and sheet form, are well known in the art. Due to the necessity of assuring complete and rapid removal and changing of processing chemical solution to eliminate uneven development and contamination of one processing solution by another solution, processing tanks have been provided with means for filling through the top and draining through the bottom to avoid the necessity of having to invert the tank to drain processing solution. However, such prior art processing devices provided with bottom drain means are rather complex in construction and are often difficult or awkward to operate. In addition, the structure of such prior art processing tanks generally does not take into consideration the desirability and/or necessity for the recovery of processing solutions to minimize the expense incident to the processing of photographic films and papers. Some prior art processing tanks provided with a bottom drain valve do include a manual drain valve operator but the complexity and/or operation thereof is not suited to the rapid efficient draining of the processing solution and more significantly is not constructed so as to readily facilitate the recovery of processing solutions for reuse or servicing of the valve to remove potentially contaminating deposits of precipitated processing chemicals or solubilized light sensitive emulsion constituents. In this regard U.S. Pat. Nos. 1,208,244; 2,530,734; 2,748,678 and 3,677,163 are exemplary of prior art processing tanks of the above described general structure. Another shortcoming of prior art developing tanks is that they are generally not of variable capacity or of variable vertical extent and therefore are not suitable for providing a tank of exactly the proper size for the intended job so as to efficiently utilize processing solutions and minimize entrainment of air during agitation to minimize spotting from air bubbles that keep the processing solutions from uniformly acting upon the photographic emulsion.

SUMMARY OF THE INVENTION

It is an object of the invention to provide a photographic film and print processing tank that provides for the efficient, economical, reliable, uniform processing of photographic film and paper.

Another object of the invention is to provide a processing tank that provides for the rapid uniform drainage of processing solutions while facilitating the recovery of the solutions in a simple efficient manner.

Another object of the invention is to provide a bottom draining processing tank having a readily serviceable bottom drain valve that preferaby coacts with a tank support to facilitate operation of the drain valve.

Another object of the invention is to provide a bottom draining processing tank that is constructed so as to enable the selective adjustment of the volumetric capacity and vertical extent of the tank to adjust the tank for each processing situation.

Other objects and advantages of the invention will be apparent to those skilled in the art by the description which follows when read in conjunction with the drawings.

The objects of the invention are attained by a processing tank in which a tank is provided with a generally conventional light tight closure and a novel bottom drain valve means whereby processing solution can be rapidly and completely drained from the tank and selectively recovered for reuse. A bottom drain valve operating means is provided to facilitate operation of the drain valve in a manner that insures complete recovery of processing solutions, which are preferably filtered during recovery. The body of the tank is provided with means for selectively varying the extent of the tank intermediate the top and the bottom drain valve carrying portion of the tank. The bottom portion is preferably provided with means to enable the tank to stand upright on a planar supporting surface. The valve operating means of the present invention preferably includes a processing tank supporting means that coacts with the valve operator to enable operation of the drain valve by relative movement of the processing tank and tank supporting means. In a preferred form of the invention the tank supporting means comprises a stand that supports the tank above a support surface a distance sufficient to enable placement of a beaker, or the like, under the bottom drain valve to collect the processing solution being drained from the tank. In order to facilitate cleaning the device, or replacement of a worn drain valve body or valve seat or valve member, the drain valve is preferably removably secured to the bottom of the processing tank. Further, within the bounds of not impeding the proper drainage of processing solutions the drain valve is preferably provided with a filter element whereby recovered processing solution may be directly returned to storage without the necessity of further handling.

DESCRIPTION OF THE DRAWINGS

Reference is now made to the accompanying drawings wherein like reference numerals designate like parts and wherein.

DESCRIPTION OF THE PREFERRED EMBODIMENTS

The device, about to be described in detail, is disclosed for use in connection with the processing of photographic film and paper. Since the device of the invention can be utilized with conventional photographic film and paper holders, such as in the form of a reel or rack, it is not considered necessary to describe the structure of such a holder that would be utilized within the device to support the sheet material being processed.

Figure 1:
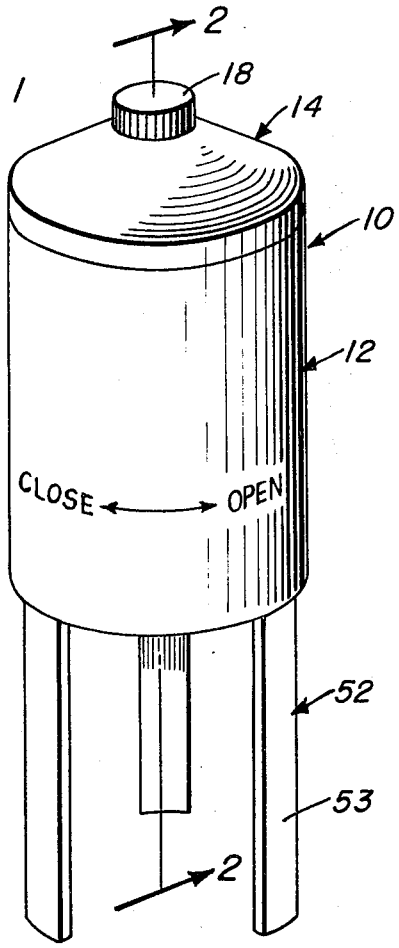
FIG. 1 is a perspective view of a photographic processing device embodying the invention.
Figure 3:
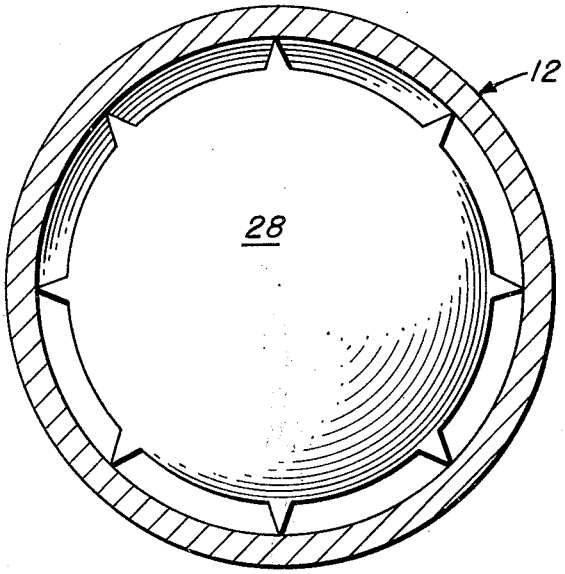
FIG. 3 is a horizontal sectional view taken along the line 3—3 of FIG. 2.

With particular reference to FIG. 1 a processing tank indicated generally at 10 includes a tubular body portion indicated at 12 and a removable top closure indicated at 14 which includes a filling opening 16 provided with a closure cap 18 and a light baffle 20. The top closure structure described above is of generally conventional construction. The tank body 12 and top closure 14 are provided with means 22, such as complementary continuous or interrupted threads for example, for coupling the tank body 12 and top closure 14 in fluid-tight relation. It will be appreciated that the specific structure of the fluid-tight coupling means is merely a matter of choice and can be of any configuration that will removably couple the members in removable fluid-tight relation.

Figure 4:
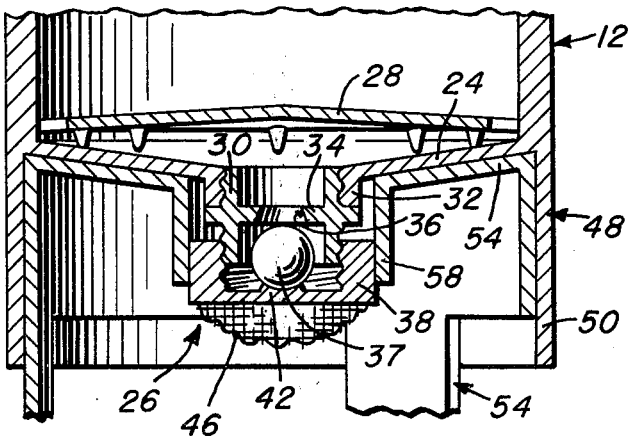
FIG. 4 is a fragmentary vertical sectional view similar to the view of FIG. 2, illustrating relative movement of certain drain valve elements.
Figure 2:
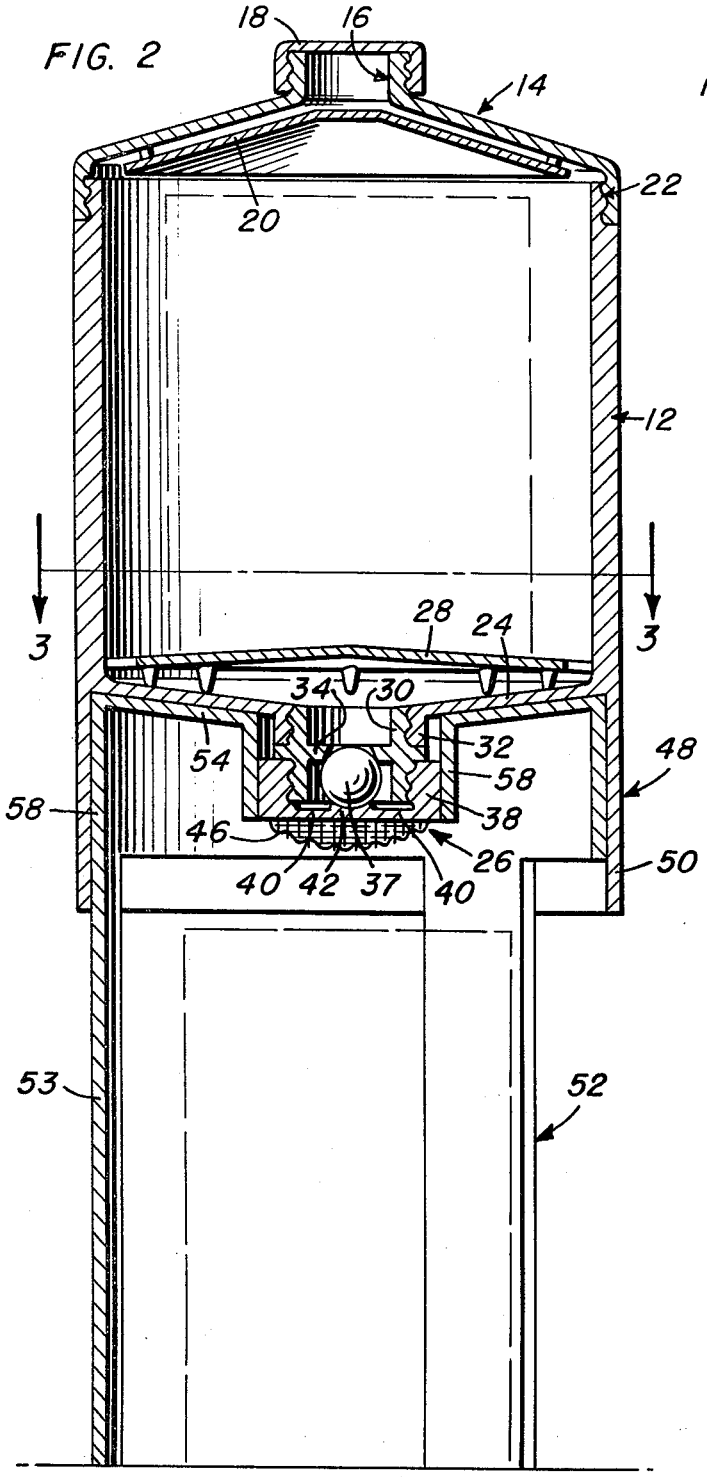
FIG. 2 is an enlarged vertical sectional view of the device of FIG. 1.
Figure 6:
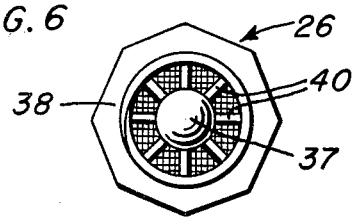
FIG. 6 is a top plan view of the drain valve operator of the device of FIG. 1.

The tank 10 includes an integral bottom wall 24 provided with a bottom drain valve means 26 for rapidly and efficiently draining processing solution from the tank 10. In the preferred embodiment illustrated, the bottom wall 24 is frusto-conical and provided with a centrally disposed outlet port 25. The drain valve means 26 is coaxial with the port 25 to insure complete draining of processing solution. A light baffle 28, either integral or removable, the latter of which is shown, is provided to preclude entry of light into the tank through valve means 26. It will be appreciated that the bottom wall may be other than frusto-conical, and the drain valve other than centrally disposed so long as processing solution will drain completely and the valve means 26 is capable of being operated by means to be described. Turning now to FIGS. 2 and 4 it will be seen that the drain valve means 26 includes a valve body 30 threadably received in a threaded boss 32 integral with the tank bottom wall 24. The valve 26 is preferably a ball valve and includes an annular valve seat 34 provided with a frusto-conical valve port 36, that coacts with a spherical or ball valve member 37. The ball 37 is positioned and operated by a valve operator member 38 threadably journaled on the valve body 30. As seen best from a consideration of FIGS. 2, 4 and 6 the valve operator 38 includes an integral spider having a plurality of arms 40 and a centrally disposed ball supporting and positioning seat 42. As seen from a comparison of FIGS. 2 and 4 axial movement of the valve operator 38 relative to the valve body 30, by virtue of rotation of the threaded coupling of the operator 38 and body 30, seats and unseats the ball 37 with respect to the valve port 36. The valve operator 38 is preferably provided with a filter element 44 downstream of the spider. It will be appreciated that the dimensions of the tank outlet port 25 and the valve port 36 are selected so as to provide rapid and complete draining of processing solution from the tank 10. The lower portion of the tank body 12 is provided with means, indicated at 48, for supporting the tank 10 on a generally planar surface. To this end an exemplary means comprises an annular skirt 50 integral with the tank body 12, which skirt 50 extends downwardly a distance at least as great as the downward extent of the valve means 26 from the bottom wall 24. The valve 26 can be operated by reaching beneath the skirt 50 and rotating the valve operator 38 to open and close the valve as shown in FIGS. 4 and 2 respectively. However, a significant aspect of the invention resides in the fact that the skirt 50 also provides a means for positioning the tank 10 on a stand 52 that comprises a means for supporting tank 10 a substantial distance above a support surface by means of a plurality of legs 53 while also providing a portion of a means for operating the drain valve 26 as a result of relative movement of the tank body 12 and stand 52. The stand is generally dimensioned so as to permit placement of a receptacle, such as a beaker, under the stand to receive solution being drained from the tank.

Figure 5:
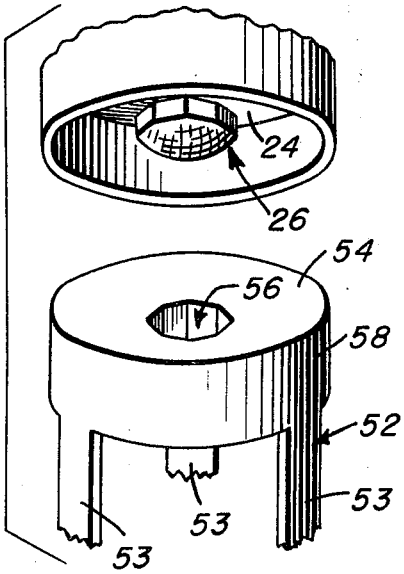
FIG. 5 is an exploded fragmentary perspective view of the embodiment of FIG. 1 showing certain details of the drain valve and drain valve operating means.

The coaction between the drain valve 26 and stand 52, in the embodiment illustrated, is effected by provision on the exterior of the valve operator 38 of means for frictional or positive engagement with a valve operator operating means carried by the stand 52. In this regard, as best seen from FIG. 5 and 6, the outer periphery of the valve operator 38 is octagonal. The stand 52 includes a top 54 configured so as to telescope within the bottom of the tank body 12 for free rotational movement with respect thereto. The top 54 of the stand is provided with an aperture 56 and a tubular extension 58 complementary to the shape of the valve operator 38 to permit upward and downward movement of the valve operator 38 relative to the stand top 54 as the operator moves along the threads of the valve body. It will be appreciated that the structural details of the drain valve means and the stand can be varied considerably from that shown without departing from the concept of operation to the valve means by relative movement between the tank body and stand. In FIG. 1 it will be seen that the tank is provided with a legend to indicate that clockwise rotation of the tank 10 relative to the stand 52 effects rotation of the valve operator 38 to close the valve, as seen in FIG. 2, and counterclockwise rotation of the tank 10 effects opening of the valve, as seen in FIG. 4.

Figure 8:
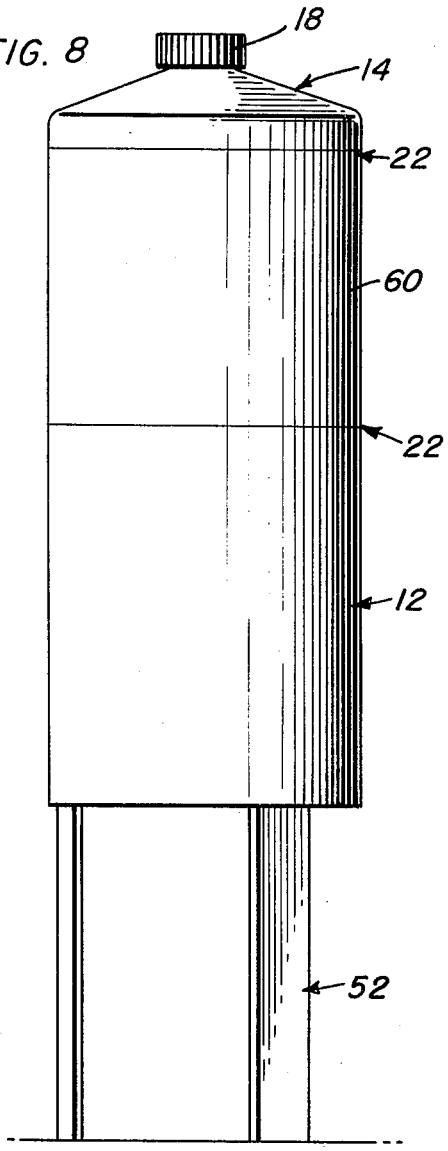
FIG. 8 is a perspective view of another embodiment of a photographic processing device embodying the invention and provided with the tubular member of FIG. 7.
Figure 7:
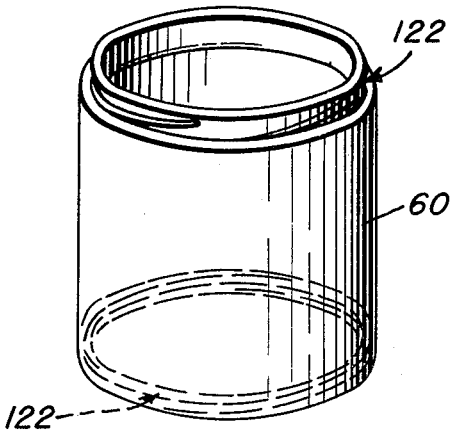
FIG. 7 is a perspective view of a tubular member for selectively varying the capacity of the device of FIG. 1.

Turning now to FIGS. 7 and 8, it will be seen that another significant aspect of the present invention resides in the provision of means for varying the volumetric capacity and vertical extent of the tank body. Toward these ends the invention contemplates the provision of one or more tubular tank body extension members, or sleeves 60, which are complementary in cross-sectional configuration to the tank body 12. The sleeves 60 are provided with coupling means 122 complementary to the coupling means 22 of the tank body 12. Thus, as seen in FIG. 8, a sleeve 60 has been coupled in fluid tight relation to the tank body 12 and the closure 14 coupled in fluid-tight relation thereto so as to increase the volumetric capacity and vertical extent of the tank body. The tank can thus be varied to accommodate a plurality of stacked film or paper carrying drums or racks, or can be varied to enable the processing of a relatively large sheet of photographic film or paper supported on a suitable drum or arcuate rack.

Although not specifically set forth heretofore it will be appreciated that the device of the present invention may be fabricated of any material that is sufficiently rigid and is suitably inert to the processing solutions normally utilized. The tank and stand normally are of molded synthetic resin. While the drain valve means 26 is illustrated as being removable, so as to facilitate cleaning of the valve and permit replacement in the event the valve is worn or damaged, it will be understood that the valve body may be formed integral with the tank body.

From the foregoing it will be appreciated that the present invention provides a very versatile photographic processing tank that is highly suited to the economical and efficient processing of film and sheet material. While the invention has been described in detail with reference to preferred embodiments thereof, it will be understood that variations and modifications can be effected within the spirit and scope of the invention.

I claim:

1. A normally light tight photographic processing device comprising:

a tank comprising a generally open top tubular body having a generally imperforate bottom wall and a removable top closure provided with a light tight processing fluid inlet;

drain valve means in said bottom wall;

support means adapted to be operatively coupled to said tank for supporting said tank above a support surface; and means carried by said support means for coaction with said drain valve means to operate said drain valve means by relative movement between said tank and said support means.

2. A device in accordance with claim 1 wherein said tubular body comprises a plurality of portions which in use are coupled in fluid-tight relation.

3. A device in accordance with claim 1 wherein said tubular body includes means for supporting said tank on a generally planar surface.

4. A device in accordance with claim 1 wherein said drain valve means is removably coupled to said bottom wall.

5. A device in accordance with claim 1 wherein said drain valve means comprises a ball valve.

6. A device in accordance with claim 1 wherein said drain valve means is operated by relative rotation between said tank and said support means.

7. A normally light tight photographic processing device comprising:

a tank comprising a generally open top tubular body having a generally imperforate generally frusto-conical bottom wall having an outlet port generally coaxial with the frustum of the bottom wall and a removable top closure provided with a light tight processing fluid inlet;

drain valve means in said generally frusto-conical bottom wall in communication with said outlet port and having a valve operator projecting downwardly from said bottom wall;

skirt means carried by said tubular body and projecting downwardly a distance at least as great as said valve operator for permitting said tank to stand on a generally planar surface;

said drain valve operator being manipulable from beneath said skirt means.

* * * * *